US006050198A

United States Patent [19]

Gersemsky et al.

[11] Patent Number: 6,050,198

[45] Date of Patent: Apr. 18, 2000

[54] TRAVELLING MECHANISM OF A RAIL-MOVABLE LIFTING DEVICE

[75] Inventors: Udo Gersemsky, Herdecke; Alfred Fänger, Wetter; Ralf Eising, Bochum, all of Germany

[73] Assignee: Mannesmann Aktiengesellschaft, Düsseldorf, Germany

[21] Appl. No.: 09/046,773

[22] Filed: Mar. 13, 1998

[30] Foreign Application Priority Data

Mar. 17, 1997 [DE] Germany ..... 197 13 500

[51] Int. Cl.[7] ..... B61B 3/00

[52] U.S. Cl. ..... 105/30; 105/33; 105/153

[58] Field of Search ..... 104/89, 93, 94, 104/95; 105/30, 32, 33, 141, 148, 150, 153, 154, 155, 156; 482/69

[56] References Cited

U.S. PATENT DOCUMENTS

| | | | |
|---|---|---|---|
| 1,367,572 | 2/1921 | Tellin . | |
| 3,498,236 | 3/1970 | Meek | 105/153 |
| 3,572,471 | 3/1971 | Martelee | 188/144 |
| 4,172,423 | 10/1979 | Monne | 104/94 |
| 4,318,346 | 3/1982 | Sessum | 105/153 |
| 4,372,452 | 2/1983 | McCord | 105/153 |
| 5,231,933 | 8/1993 | DiRosa | 105/153 |
| 5,419,260 | 5/1995 | Hamilton | 105/153 |

FOREIGN PATENT DOCUMENTS

| | | | |
|---|---|---|---|
| 1.365.028 | 7/1965 | France . | |
| 432859 | 11/1924 | Germany | 105/153 |
| 432859 | 7/1926 | Germany . | |
| 1 288 269 | 9/1969 | Germany . | |
| 26 18 516 C2 | 5/1978 | Germany | B61B 3/02 |
| 4205858 | 9/1993 | Germany | 105/30 |
| 2 104 020 | 3/1983 | United Kingdom | B61B 3/00 |
| 2 265 348 | 9/1993 | United Kingdom | B61B 13/04 |

*Primary Examiner*—Mark T. Le

*Attorney, Agent, or Firm*—Cohen, Pontani, Lieberman & Pavane

[57] ABSTRACT

A travelling mechanism for a rail-movable lifting device includes a carrier with running wheels which roll on a longitudinally extending running surface of a rail. A double lever is pivotally mounted on the carrier. A drivable friction wheel that is positionable on a longitudinally extending friction surface of the rail is rotatably mounted on the double lever. An opposing side of the double lever supports the lifting device, whereby the double lever presses the friction wheel against the friction surface of the rail by a force under the weight of the lifting device.

6 Claims, 4 Drawing Sheets

TRAVELLING MECHANISM OF A RAIL-MOVABLE LIFTING DEVICE

BACKGROUND OF THE INVENTION

1. Field of the Invention

The invention relates to a travelling mechanism of a rail-movable lifting device. More particularly, the invention relates to a travelling mechanism of a rail-movable lifting device with a friction wheel that is pressed onto a friction surface of the rail by a force that is proportional to a load on the lifting device.

2. Description of the Related Art

It is generally known to use ceiling lifts for transporting handicapped or sick persons to keep the ground free and clear. These ceiling lifts run on, for example, hollow-profile-type rails mounted in a region of the ceiling. The ceiling lift is moved along the rails by a travelling mechanism, which has a drive unit and a support unit that are connected to each other by an articulated rod.

The drive unit has running surfaces for travelling wheels that roll on the rails. These travelling wheels rest on the rails and are rotary-mounted on a shared carrier. The driving element is a motor, whose driving forces are transmitted to the travelling mechanism by a friction wheel that rests on a friction surface of the rails. The running surfaces and the friction surface are usually arranged parallel to each other. The support unit also has travelling wheels that, like the travelling wheels of the drive unit, roll on the running surfaces of the rails and are rotary-mounted on a shared carrier. The carrier is connected to the travelling mechanism below the rails.

In this known travelling mechanism for ceiling lifts, the friction wheel rests on the friction surface while being subjected to a pressure force. The pressure force must be selected such that flawless driving characteristics are ensured even at maximum load. For example, the friction wheel must not spin even at maximum load. In travelling mechanisms of this type, the friction wheel may be subject to high wear. Furthermore, the elastic friction wheel, because it is subjected to a pressure force while resting on the friction surfaces, experiences deformation if the ceiling lift is not moved for long periods of time. This deformation may be associated initially with an irregular running of the carrier when the lift is put into operation again. Moreover, the travelling mechanism is often difficult to move by hand because of the pressure force of the elastic friction wheel against the rail.

A travelling mechanism having a drive unit and support unit formed integrally is described in German reference DE 1288269. In this reference, the friction wheel is pressed onto a friction surface using a preloaded spring.

Another German reference, DE 26 18 516 C2, discloses a trolley of a rail-movable lifting device with a driven travelling wheel that serves as a supporting and driving wheel. The driven travelling wheel rolls on a running surface, which extends in the longitudinal direction of a rail and serves as the friction surface for the driven travelling wheel. An auxiliary travelling wheel is provided in the form of a wheel that is rotatably-mounted at a distance from the distance travelling wheel, seen in the direction of travel, on an end of a pivotable lever. During normal operation of the trolley the auxiliary wheel does not roll on the running surface of the rail, but instead remains in a parked position. In the event of failure or malfunction of the drive, the supporting wheel is placed onto the running surface by activating the lever; specifically, the free lever end of the lever, which is embodied as a double lever, is pulled vertically downward. The free end of the double lever is pulled downward until the auxiliary wheel assumes its working position, whereby the axis of the auxiliary travelling wheel is offset from the vertical, below the pivot axis, in the direction of the driven travelling wheel. In its working position, the auxiliary wheel interacts with a supporting wheel that is located across from the driven travelling wheel, seen in the direction of travel, such that the auxiliary wheel and the supporting wheel roll on the running surface of the rail, while the driven travelling wheel is lifted from the running surface Thereby enabling manual movement of the trolley even during malfunctions of the drive.

Finally, U.S. Pat. No. 1,367,522 discloses a travelling mechanism, which, however, has no force-pressurized friction wheel resting on a running surface of a rail. In this case, the drive is provided by a toothed wheel which engages, for example, into a toothed rack of the rail. This drive by means of interengaged teeth requires no pressure force, as is required in the case of a friction wheel that rests on a friction surface to drive the travelling mechanism.

SUMMARY OF THE INVENTION

It is an object of the invention to provide a travelling mechanism for a rail-movable lifting device with a friction wheel that exhibits low wear and, despite being low-maintenance, ensures an even drive even under maximum load.

According to the invention, this object is attained by a travelling mechanism of a rail-movable lifting device, which has travelling wheels that roll on rolling surfaces extending in the longitudinal direction of a rail, and has a drivable friction wheel positionable on a friction surface extending in the longitudinal direction of the rail and that is rotatably mounted on a lever that is pivotally mounted and which presses the friction wheel in a force-pressured manner against the friction surface.

According to a feature of the invention, the lever is a double lever, on one side of which the friction wheel is mounted and on the other side of which the lifting device is supported.

A travelling mechanism embodied in this fashion ensures that the friction wheel is pressed onto the friction surface of the rail in a manner dependent on load. Thus, under a heavy load, the friction wheel is subjected to a large force; if there is no load, the force exercised on the friction wheel results only from the intrinsic weight of the lifting device, which is usually slight. Deformation of the friction wheel, particularly during long periods of non-use, is thus avoided in the travelling mechanism according to the invention.

A lightweight ceiling lift is attained by the fact that the rail is a hollow-profile-type rail open toward the bottom and with running surfaces arranged in its interior.

A stable structure of the ceiling lift is attained by the use of a T-shaped or double-T-shaped rail, on a flange of which the running surface and the friction surface are embodied.

Advantageously, the friction wheel and the lifting device are float-mounted on the double lever. The ease of accessibility to the components enables simple repair and simple replacement of worn parts.

To achieve easy manual movement of the travelling mechanism, it is proposed that the double lever have a substantially horizontal slot below the pivot axis, wherein the slot extends to both sides of an imaginary vertical plane passing through the pivot axis.

Advantageously, the slot is convex in the direction of the pivot axis, so that the lifting device does not subsequently move on its own accord toward the other side. To attain high flexibility when people are being transported, the center of the double lever is connected to the carrier via an articulated joint of the cardanic type. This ensures that when the load moves in pendulum fashion in the direction of travel, the lever arm of the carrier and thus the relative pressure force of the friction wheel change only slightly, and also makes it possible to laterally pivot the lifting device simply and without danger.

It is proposed that the lifting device be mounted so as to be rotatable around a vertical axis, allowing persons being transported to be turned in the most favorable position.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
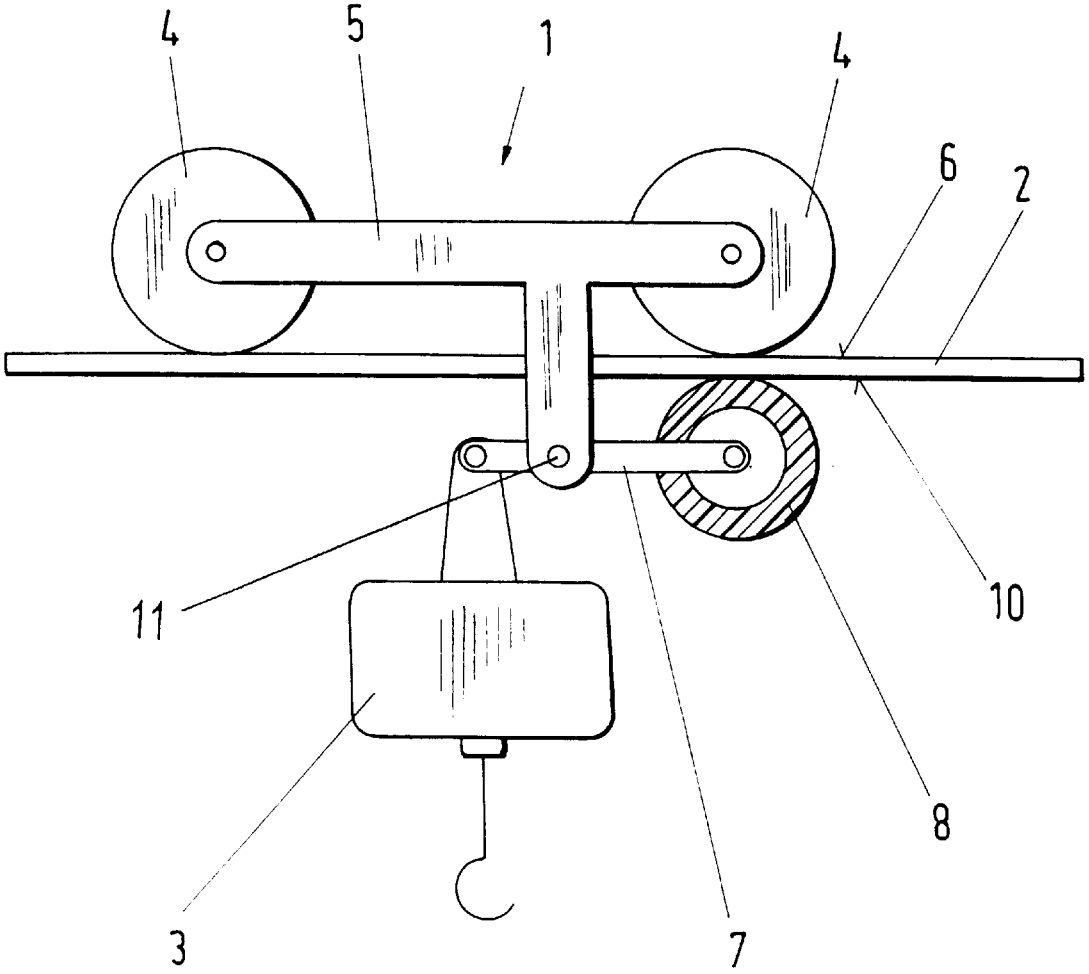
FIG. 1 is a schematic drawing showing the side view of an embodiment of the travelling mechanism of the present invention.

Referring to FIG. 1, a travelling mechanism 1 FOR a lifting device 3 that is movable on a rail 2 includes travelling wheels 4 located one behind the other along the longitudinal direction of the rail 2 and arranged next to each other in pairs. The travelling wheels 4 are connected to each other on a shared carrier 5, on which they are freely rotatably mounted. The travelling wheels 4 are arranged in the rail 2 such that they are rollable on substantially horizontal running surfaces 6 that extend in the longitudinal direction in the rail 2.

The carrier 5 extends partially between the running wheels 4 and below the rail 2. A double lever 7 is pivotally connected about a pivot axis 11 to a lower portion of the carrier 5 and is connected to a friction wheel 8. The friction wheel 8 is rotatably float-mounted on a free end of the double lever 7 and is drivable by a motor 9 (see FIG. 3). On the other end of the double lever 7, the lift device 3 is connected in floating and pivotable fashion.

The intrinsic weight of the lift device 3 acting upon one end of the double lever 7 causes the friction wheel 8 to be pressed against a friction surface 10 of the rail 2 when the lifting device is in the unloaded state. The pressure force is counteracted only by the intrinsic weights of the friction wheel 8 and the drivable motor 9. The magnitude of the pressure force in the unloaded state depends on the selected lever ratios of the double lever 7 and is established by the choice of the suspension point such that the friction wheel 8 always rests under slight pressure on the friction surface 10. In the loaded state, the magnitude of the pressure force is proportional to the particular load.

As FIG. 1 shows, a pair of the travelling wheels 4 is arranged across from the friction wheel 8. This arrangement effectively prevents the cross-migration of the friction wheel on curves. In the example, the running surfaces 6 and the friction surface 10 of the rail run parallel to each other.

Figure 2:
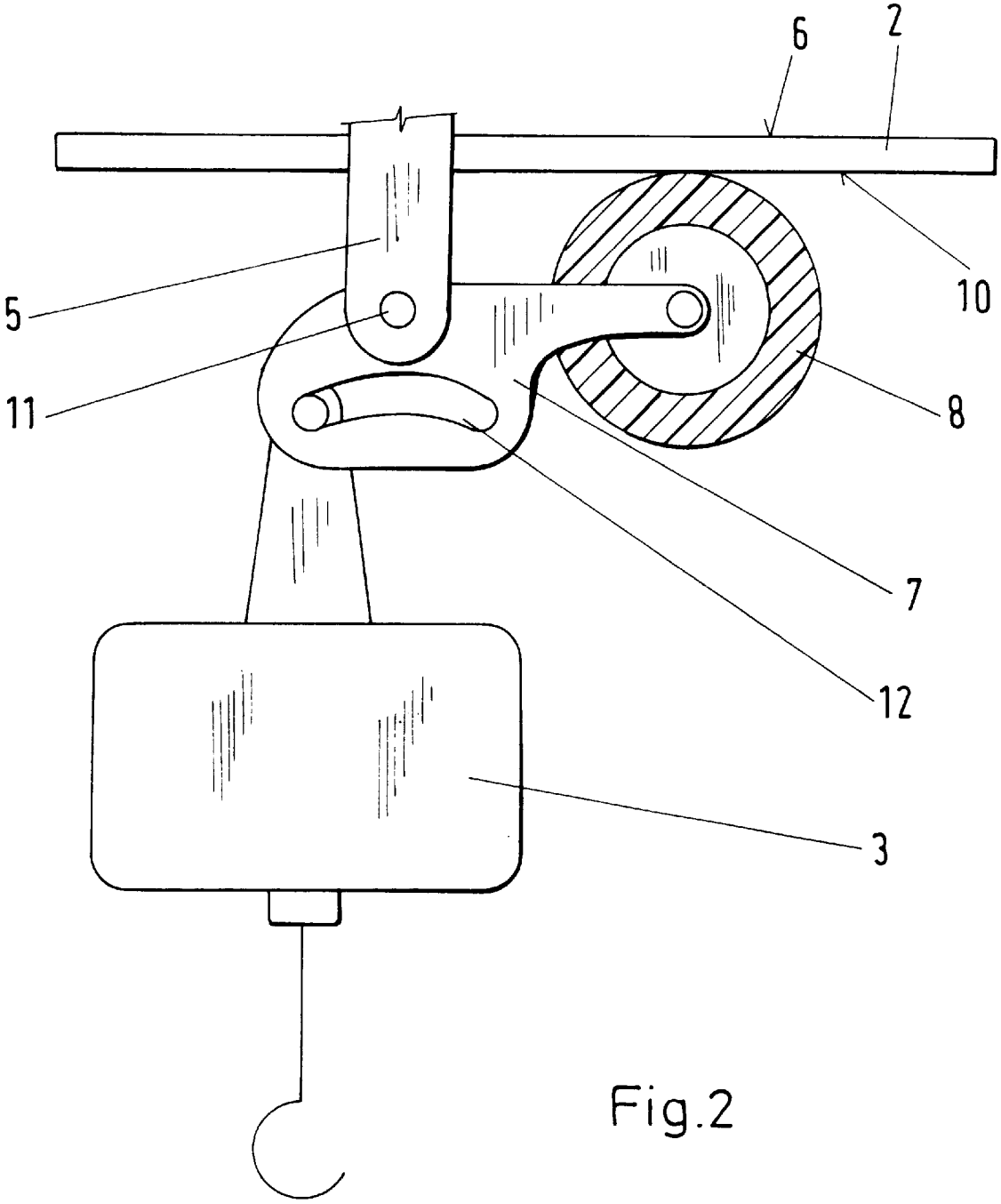
FIG. 2 shows another embodiment of the travelling mechanism shown in FIG. 1 with a slot in a lever of the travelling mechanism.

Referring now to FIG. 2, another embodiment of the travelling mechanism includes a double lever 7' with a substantially horizontal slot 12 below the pivot axis 11. The slot 12 extends to both sides of an imaginary vertical plane that passes through the pivot axis 11. The slot 12 is embodied so as be convex in the direction of the pivot axis 11. As a result, the lifting device 3 is movable from one side of the vertical plane (one side of the rotational point of the pivot axis) to the other. When the lift device 3 is positioned on the same side of the pivot axis as the friction wheel 8, the friction wheel 8 is relieved, and the travelling mechanism 1 is easily moved by hand on the rail.

Instead of pivot axis 11, the double lever 7' may be connected to the carrier 5 by an articulated joint of the cardanic type.

Figure 3:
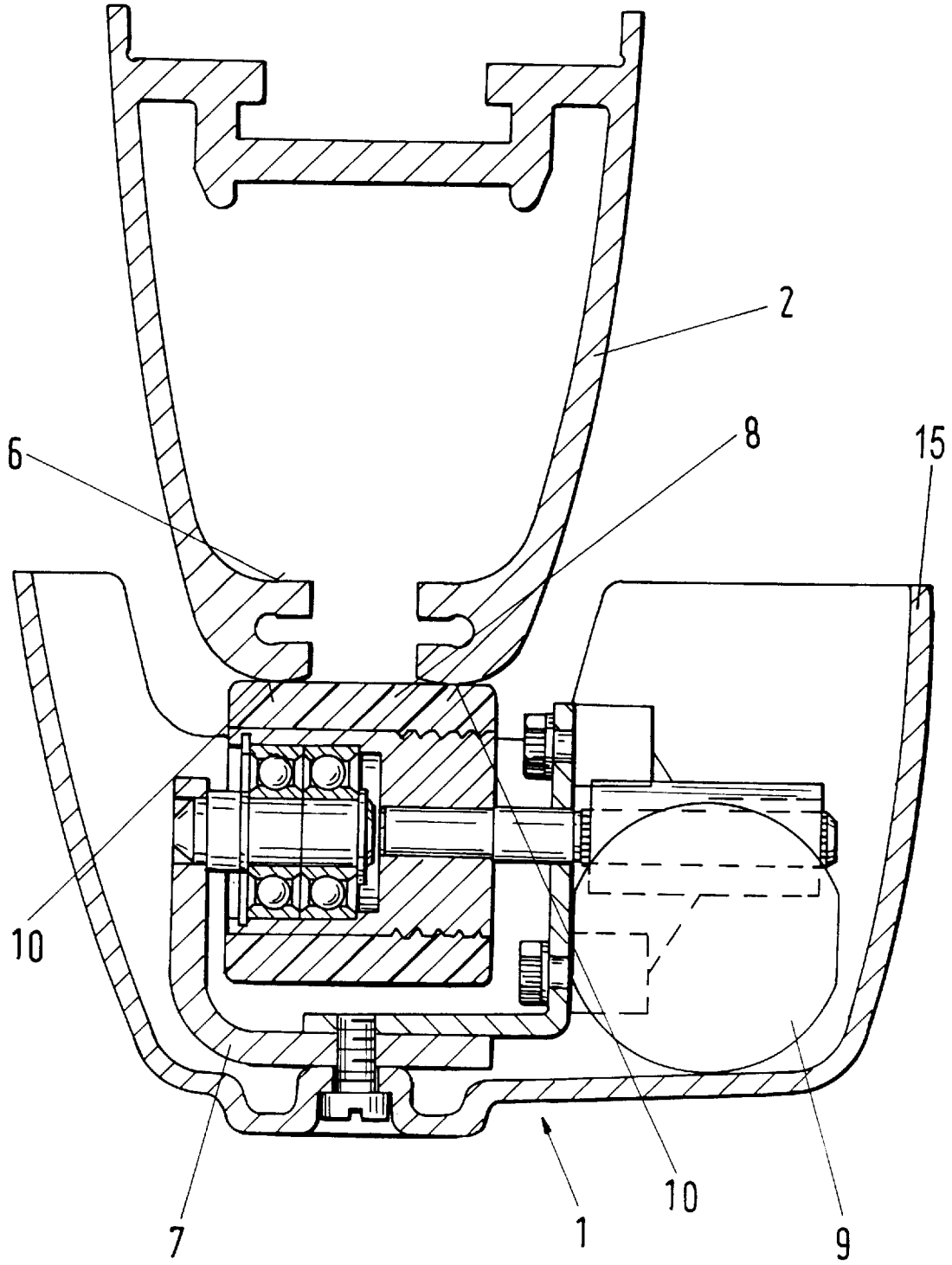
FIG. 3 shows a cross-section through a drive wheel of the travelling mechanism of the present invention on a hollow-profile-type rail.
Figure 4:
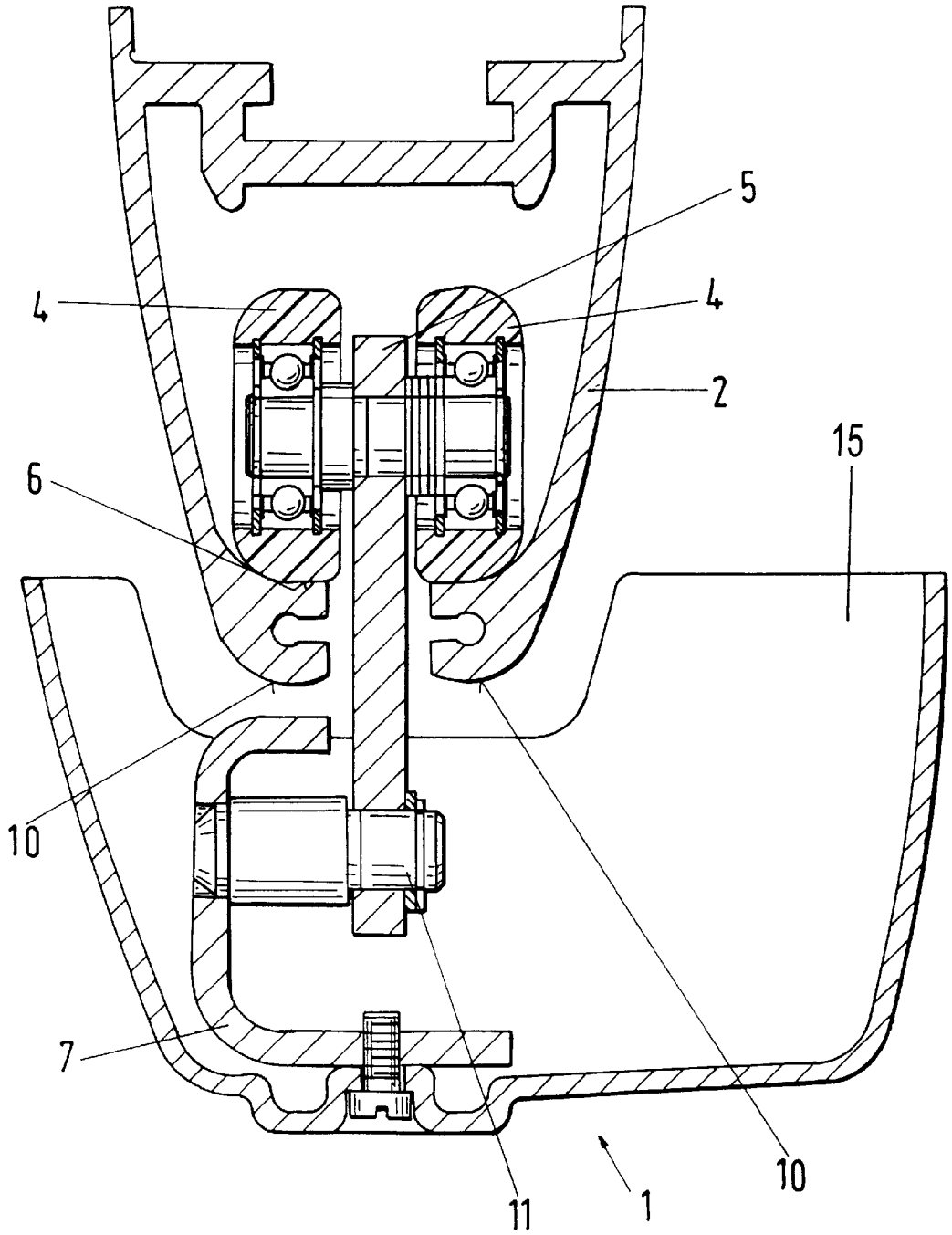
FIG. 4 shows a cross-section through a running wheel of the travelling mechanism of the present invention in a hollow-profile-type rail.

FIG. 3 shows a first cross-section through the friction wheel 8 of the travelling mechanism 1, which is movable on a hollow-profile-type rail 2 that is open toward the bottom and has running surfaces 6 arranged in the interior. FIG. 3 also shows the mounting of a motor 9 that is drivably connected to friction wheel 8. FIG. 4 shows a second cross-section, in keeping with FIG. 3, with a section through the axes of a pair of travelling wheels 4. Both FIGS. 3 and 4 show a cover 15 which protects the moving portions of the travelling mechanism 1 from external elements which may damage the movable portions of the device.

Instead of the rail 2, T-shaped or double-T-shaped rails may also be used. The running surfaces 6 and the friction surface 10 are then embodied on one flange of the rail. To allow the person being transported to be turned in the best position, it is advantageous to mount the lifting device 3 on the double lever 7 so as to be rotatable around a vertical axis.

The invention is not limited by the embodiments described above which are presented as examples only but can be modified in various ways within the scope of protection defined by the appended patent claims.

We claim:

1. A travelling mechanism for moving a lifting device supporting a load along a rail, comprising:

a carrier;

travelling wheels rotatably mounted on said carrier for rolling on a longitudinally extending running surface in the rail;

a double lever pivotally connected to said carrier about a pivot axis and having a first arm and a second arm on opposing sides of said pivot axis; and a drivable friction wheel rotatably mounted on the first arm of said double lever and the second arm supportably connectable to the lifting device;

wherein said double lever urges said friction wheel against a longitudinally extending friction surface of the rail by an urging force when the lifting device is supported by the second arm, said force being dependent on an amount of weight of the load supported by the lifting device.

2. The travelling mechanism of claim 1, wherein the rail comprises a hollow-profile rail that is open toward the bottom and the running surface is arranged in an interior of the rail.

3. The travelling mechanism of claim 1, wherein said friction wheel and the lifting device are float-mounted on the double lever.

4. The travelling mechanism of claim 1, wherein the double lever comprises a substantially horizontal slot below the pivot axis extending through a vertical plane passing through the pivot axis.

5. The travelling mechanism of claim 4, wherein the slot is convex toward the pivot axis.

6. The travelling mechanism of claim 1, wherein the urging force is proportional to an amount of the load on the lifting device.

* * * * *